US007997928B2

(12) United States Patent
Deren et al.

(10) Patent No.: US 7,997,928 B2
(45) Date of Patent: Aug. 16, 2011

(54) MULTI-POSITION COAXIAL CONNECTOR SYSTEM

(75) Inventors: Jason E. Deren, West Hartford, CT (US); Steven Pollevoy, Torrington, CT (US)

(73) Assignee: FCT Electronics, LP, Torrington, CT (US)

( * ) Notice: Subject to any disclaimer, the term of this patent is extended or adjusted under 35 U.S.C. 154(b) by 0 days.

(21) Appl. No.: 12/516,903

(22) PCT Filed: Nov. 30, 2007

(86) PCT No.: PCT/US2007/086087

§ 371 (c)(1),
(2), (4) Date: Apr. 6, 2010

(87) PCT Pub. No.: WO2008/070558

PCT Pub. Date: Jun. 12, 2008

(65) Prior Publication Data

US 2010/0197168 A1 Aug. 5, 2010

Related U.S. Application Data

(60) Provisional application No. 60/868,145, filed on Dec. 1, 2006.

(51) Int. Cl.
*H01R 9/09* (2006.01)

(52) U.S. Cl. ..... 439/578; 439/63

(58) Field of Classification Search ..... 439/578–585, 439/63

See application file for complete search history.

(56) References Cited

U.S. PATENT DOCUMENTS

| | | | | |
|---|---|---|---|---|
| 4,084,875 | A | 4/1978 | Yamamoto | |
| 5,055,055 | A | 10/1991 | Bakker | |
| 5,055,068 | A | 10/1991 | Machura et al. | |
| 5,192,226 | A * | 3/1993 | Wang | 439/502 |
| 5,292,256 | A | 3/1994 | Brunker et al. | |
| 5,509,821 | A | 4/1996 | Small et al. | |
| 5,885,088 | A | 3/1999 | Brennan et al. | |
| 6,015,315 | A * | 1/2000 | Ensign et al. | 439/578 |
| RE37,368 | E | 9/2001 | Huppenthal et al. | |
| 6,371,790 | B1 | 4/2002 | Huang | |
| 2003/0045165 | A1 * | 3/2003 | Kikuchi et al. | 439/578 |
| 2005/0026506 | A1 | 2/2005 | Kha et al. | |

OTHER PUBLICATIONS

International Search Report and The Written Opinion of the International Searching Authority, international Application No. PCT/US2007/086087, filed Nov. 30, 2007.

* cited by examiner

*Primary Examiner* — Gary F. Paumen
(74) *Attorney, Agent, or Firm* — Wiggin and Dana LLP; Anthony P. Gangemi

(57) ABSTRACT

Systems for connecting RF coaxial cables are disclosed. In some embodiments, the systems include the following: a plug including a D-sub housing having two rows of eight RF coaxial contacts and a plurality of protrusions extending therefrom; a receptacle including a D-sub housing having two rows of eight openings and a plurality of indentations that are sized and positioned so as to mate with the protrusions extending from the plug, the receptacle including a rear unibody joined with the D-sub housing and a transition body positioned between and joining the D-sub housing and the rear unibody. The plug and receptacle are configured to provide about a 50-Ohm impedance across the system and the plug and receptacle are configured to operate under a ground-first condition.

19 Claims, 6 Drawing Sheets

MULTI-POSITION COAXIAL CONNECTOR SYSTEM

CROSS REFERENCE TO RELATED APPLICATION(S)

This application claims the benefit of U.S. Provisional Application No. 60/868,145, filed Dec. 1 2006, which is incorporated by reference as if disclosed herein in its entirety.

BACKGROUND

As various technologies progress, the amount of data, the rates of data transmission, and the number of data channels continues to increase. In order to process and transmit data, various transmission cables are joined with hardware, e.g., computer systems, hardware, computer network routers, etc., via connector systems.

Generally, as the amount of data increases, the number of transmission cables or wires within a transmission cable must increase to handle the increased amount of data. Unfortunately, connector system technology has failed to progress with the growth in data amounts and data channels. For example, for systems having 64 channels, using the known 8W8 connector systems requires the stacking of eight separate connector systems, which requires a significant amount of space. In many systems, the amount of space to fit the cables and connector systems is limited. For many technologies, there is a drive to reduce the overall size of the technology thereby further limiting the amount of space available for connector systems.

SUMMARY

Systems for connecting RF coaxial cables are disclosed. In some embodiments, the system includes the following: a plug including the following: a D-sub housing having a front surface, the housing being sized no larger than size five; two rows of eight RF coaxial contacts extending from the front surface of the D-sub housing, each of the RF coaxial contacts including a center contact portion, each of the RF coaxial contacts having a closed entry configuration; a receptacle including the following: a D-sub housing having a front surface including two rows of eight openings therein, the D-sub housing being sized no larger than size five; a receptacle contact positioned in each of the eight openings, each of the receptacle contacts being configured to mate with one of the RF coaxial contacts via the closed entry configuration, each of the receptacle contacts having first and second sections, the receptacle contacts being positioned so that at least a portion of the first section is positioned in the D-sub housing; and a rear unibody joined with the D-sub housing, the rear unibody being positioned so that at least a portion of the second portions of the receptacle contacts is positioned within the rear unibody; wherein the plug and receptacle are configured to provide about a 50 Ohm impedance across the system and the plug and receptacle are configured to operate under a ground-first condition.

Systems for connecting RF coaxial cables are disclosed. In some embodiments, the system includes the following: a plug including the following: a D-sub housing having a front surface, the housing being sized no larger than size five; two rows of eight RF coaxial contacts extending from the front surface of the D-sub housing, each of the RF coaxial contacts including a center contact portion, each of the RF coaxial contacts having a closed entry configuration; a receptacle including the following: a D-sub housing having a front surface including two rows of eight openings therein, the D-sub housing being sized no larger than size five; a receptacle contact positioned in each of the eight openings, each of the receptacle contacts being configured to mate with one of the RF coaxial contacts via the closed entry configuration, each of the receptacle contacts having first and second sections, the receptacle contacts being positioned so that at least a portion of the first section is positioned in the D-sub housing; and a rear unibody joined with the D-sub housing, the rear unibody being positioned so that at least a portion of the second portions of the receptacle contacts is positioned within the rear unibody; and a transition body positioned between and joining the D-sub housing and the rear unibody; wherein the plug and receptacle are configured to provide about a 50 Ohm impedance across the system and the plug and receptacle are configured to operate under a ground-first condition.

Systems for connecting RF coaxial cables are disclosed. In some embodiments, the system includes the following: a plug including the following: a D-sub housing having a front surface, the housing being sized no larger than size five; two rows of eight RF coaxial contacts extending from the front surface of the D-sub housing, each of the RF coaxial contacts including a center contact portion, each of the RF coaxial contacts having a closed entry configuration; protrusions extending from the front surface of the D-sub housing; a receptacle including the following: a D-sub housing no larger than size five, the housing including a surface having two rows of eight openings, the surface having indentations, the indentations being sized and positioned so as to mate with the protrusions extending from the plug; a receptacle contact positioned in each of the eight openings, each of the receptacle contacts being configured to mate with one of the RF coaxial contacts via the closed entry configuration, each of the receptacle contacts having first and second sections, the receptacle contacts being positioned so that at least a portion of the first section is positioned in the D-sub housing; and a rear unibody joined with the D-sub housing, the rear unibody being positioned so that at least a portion of the second portion of the receptacle contact portion is positioned within the rear unibody; wherein the plug and receptacle are configured to provide about a 50 Ohm impedance across the system and the plug and receptacle are configured to operate under a ground-first condition.

BRIEF DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION

Figure 1A:
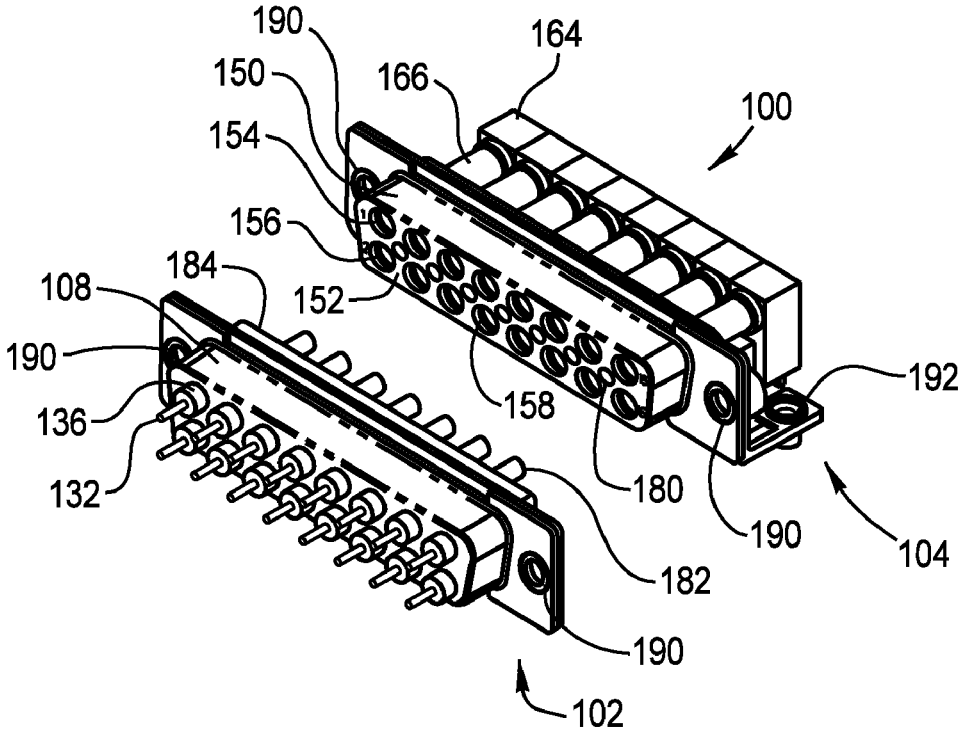
FIGS. 1A and 1B are front isometric views of a connector system according to some embodiments of the disclosed subject matter.
Figure 1B:
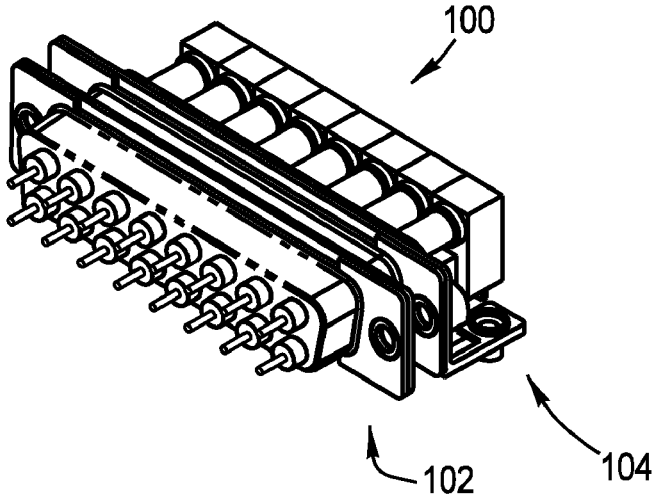

Generally, the disclosed subject matter relates to systems for connecting RF coaxial cables. Referring now to FIGS. 1A-2B, one aspect of the present invention is a connector system 100. In some embodiments, connector system 100 includes a plug 102 that removably connects with a receptacle 104. FIG. 1A shows plug 102 and receptacle 104 as disconnected and FIG. 1B shows plug 102 and receptacle 106 as connected. As best shown in FIG. 2A, FIGS. 1A-2B illustrate an embodiment where receptacle 104 includes a right angle D-sub housing 106. However, other embodiments may include non-right angle D-sub housing, e.g., contacts that extend horizontally through housing.

Figure 4:
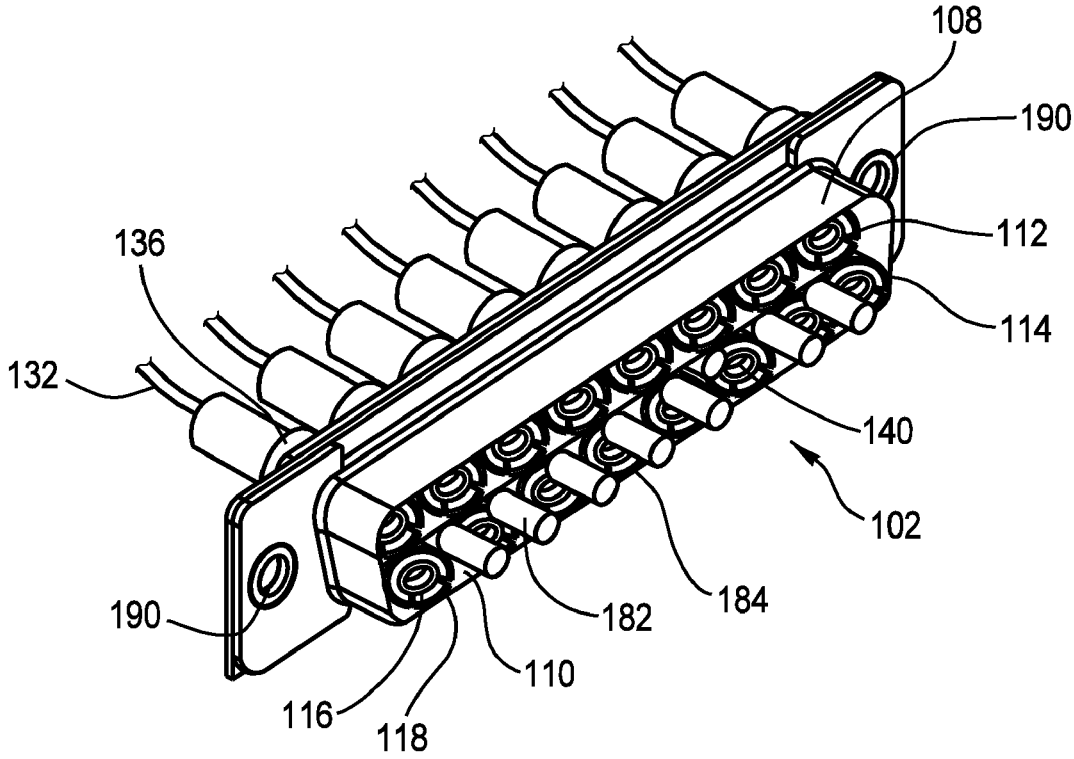
FIG. 4 is a front isometric view of a plug according to some embodiments of the disclosed subject matter.

Still referring to FIGS. 1A-2B and also referring to FIG. 4, plug 102 includes a D-sub housing 108 having a front surface 110. D-sub housing 108 is generally no larger than size five according to Department of Defense specification MIL-DTL-24308. Housing 108 includes two rows 112, 114 of eight RF coaxial contacts 116 extending from front surface 110 of D-sub housing 108.

Figure 5:
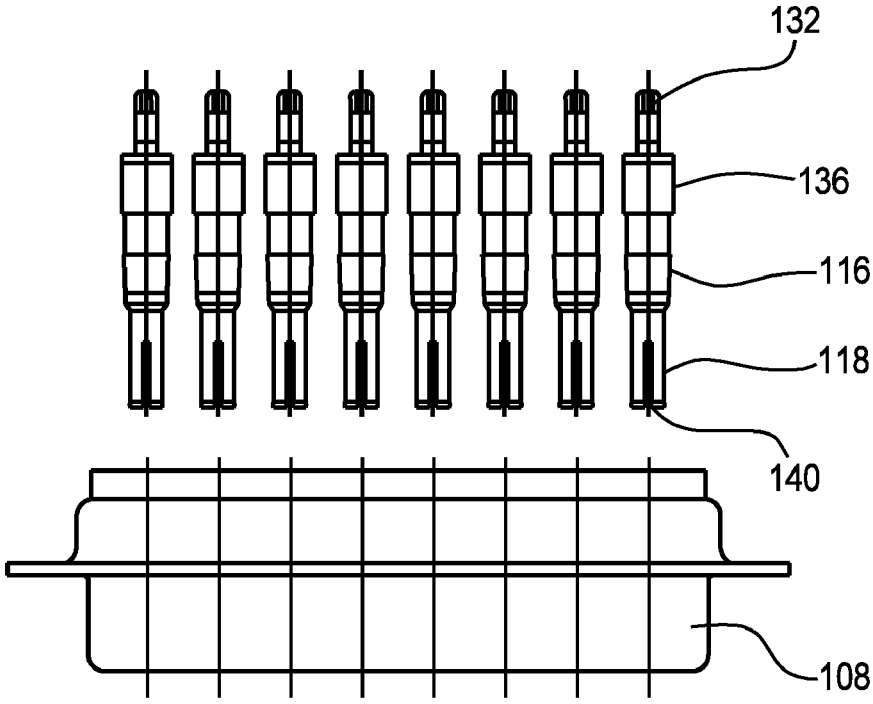
FIG. 5 is an exploded top plan view of a plug according to some embodiments of the disclosed subject matter.
Figure 6:
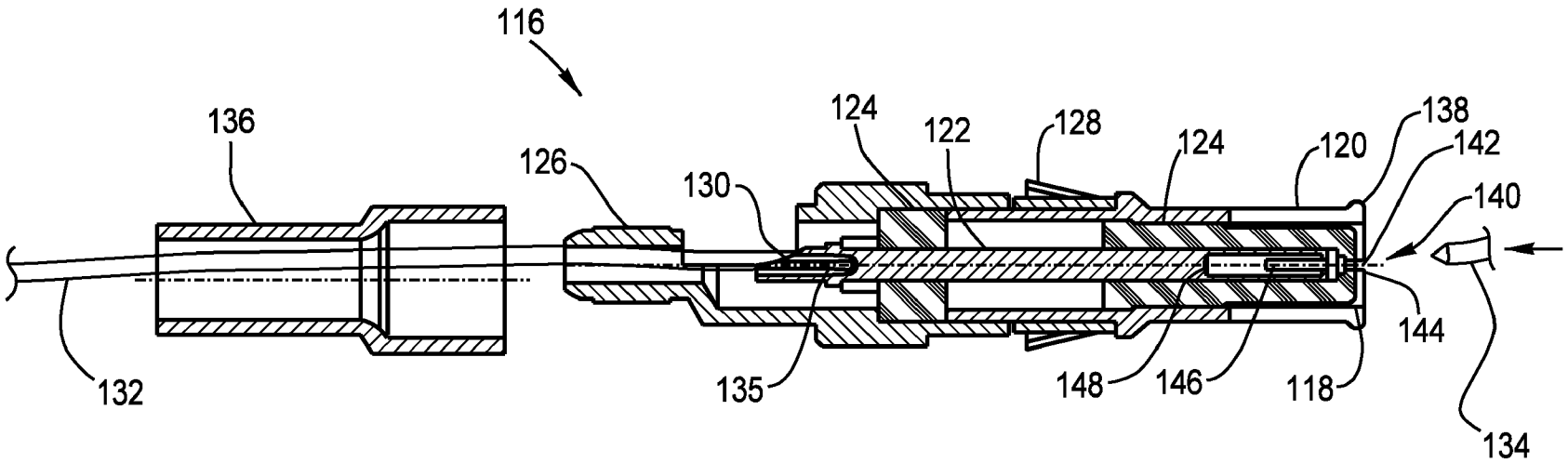
FIG. 6 is a side section view of a contact according to some embodiments of the disclosed subject matter.

Referring also to FIGS. 4-6, in some embodiments, RF coaxial contacts 116 are similar to an MCX design as delineated in European specification CECC 22220. RF coaxial contacts 116 generally, but not always, include a mechanism for making a pressure fit or friction mating connection with receptacle 104, e.g., finger portions 118 or a spring band (not shown) defined on a front body 120 of RF coaxial contact 116, or similar. Each of RF coaxial contacts 116 includes a center contact portion 122. In some embodiments, center contact portion 122 is fabricated from beryllium copper or a similar material. In some embodiments, center contact portion 122 has a diameter that is smaller than a diameter of about a size eight contact according to the American Wire Gauge standard. In some embodiments, center contact portion 122 has a diameter that is larger than a diameter of about a size eight contact according to the American Wire Gauge standard. RF coaxial contacts 116 include insulator portions 124 that are configured so that plug 102 and receptacle 104 provide about a 50-Ohm impedance across system 100 regardless of the diameter of center contact portion 122.

As best illustrated in FIG. 6, in some embodiments, front body 120 of RF coaxial contact 116 is joined with a rear body 126 via a clip ring 128. Rear body 126 includes a groove 130 for receiving a coaxial cable 132 to be connected with a receptacle contact 134 via center contact portion 122. Coaxial cable 132 generally includes a center conductor portion 135 surrounded by an outside cable braid (not shown). Center conductor portion 135 of coaxial cable 132 is typically, but not always, soldered to center contact portion 122 and the outside cable braid (not shown) is typically, but not always, semi-permanently joined with rear body 126 using a crimp ferrule 136 or similar, e.g., a screw ferrule, etc. Front body 120 of RF coaxial contact 116 includes an end 138 having a closed entry configuration 140. Closed entry configuration 140 can be defined by a guided entry hole 142 having chamfered edges 144 for helping funnel or guide receptacle contact 134 into a groove 146 within front body 120. An end 148 of groove 146 is defined by center contact portion 122 thereby connecting receptacle contact 134 with one or more coaxial cables 132 via the center contact portion.

Figure 2A:
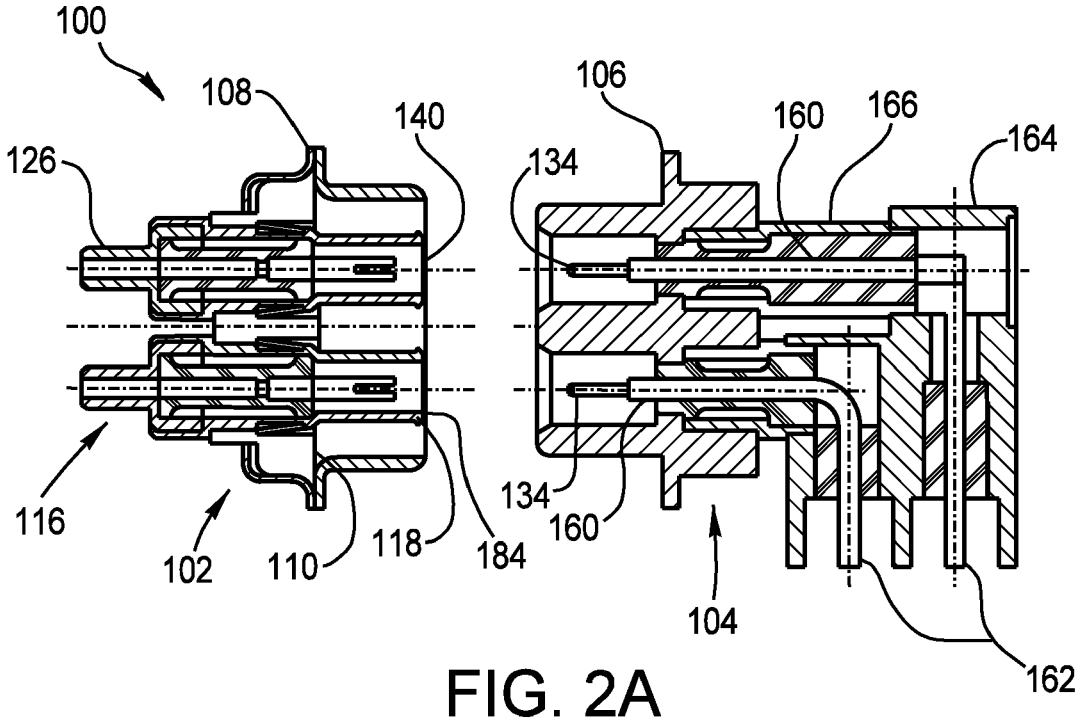
FIGS. 2A and 2B are side section views of the connector system in FIGS. 1A and 1B, respectively.
Figure 2B:
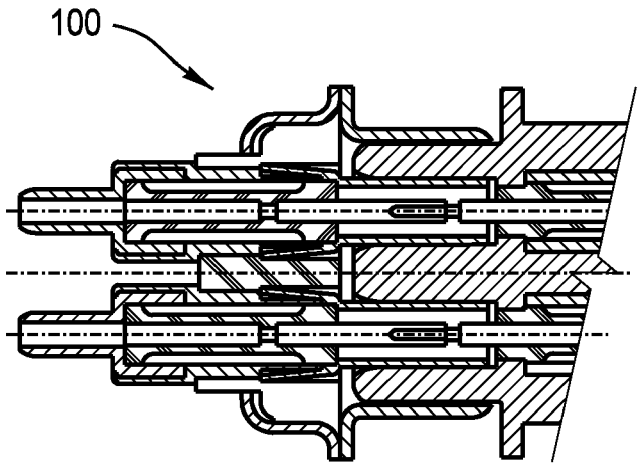

Referring again to FIGS. 1A-2B, receptacle 104 includes a D-sub housing 150 having a front surface 152 including two rows 154, 156 of eight openings 158 therein. Generally, but not always, D-sub housing 150 is sized no larger than size five. Receptacle contact 134 is positioned in each of openings 158. Each of receptacle contacts 134 is configured to mate with one of RF coaxial contacts 116 via closed entry configuration 140. As best shown in FIGS. 2A and 2B, each of receptacle contacts 134 includes a first section 160 and a second section 162. Receptacle contacts 134 are positioned so that at least a portion of first section 160 is positioned in D-sub housing 150. In some embodiments, at least some of receptacle contacts 134 are defined by two separate pieces of material that are soldered together and in some embodiments, at least some of the receptacle contacts are defined by a single contiguous piece of material.

In some embodiments, receptacle 104 includes a rear unibody 164 joined with said D-sub housing. Rear unibody 164 is positioned so that at least a portion of second portion 162 of receptacle contact 134 is positioned within the rear unibody. In some embodiments, D-sub housing 150 and rear unibody 164 are fabricated from a die cast zinc material.

Figure 3:
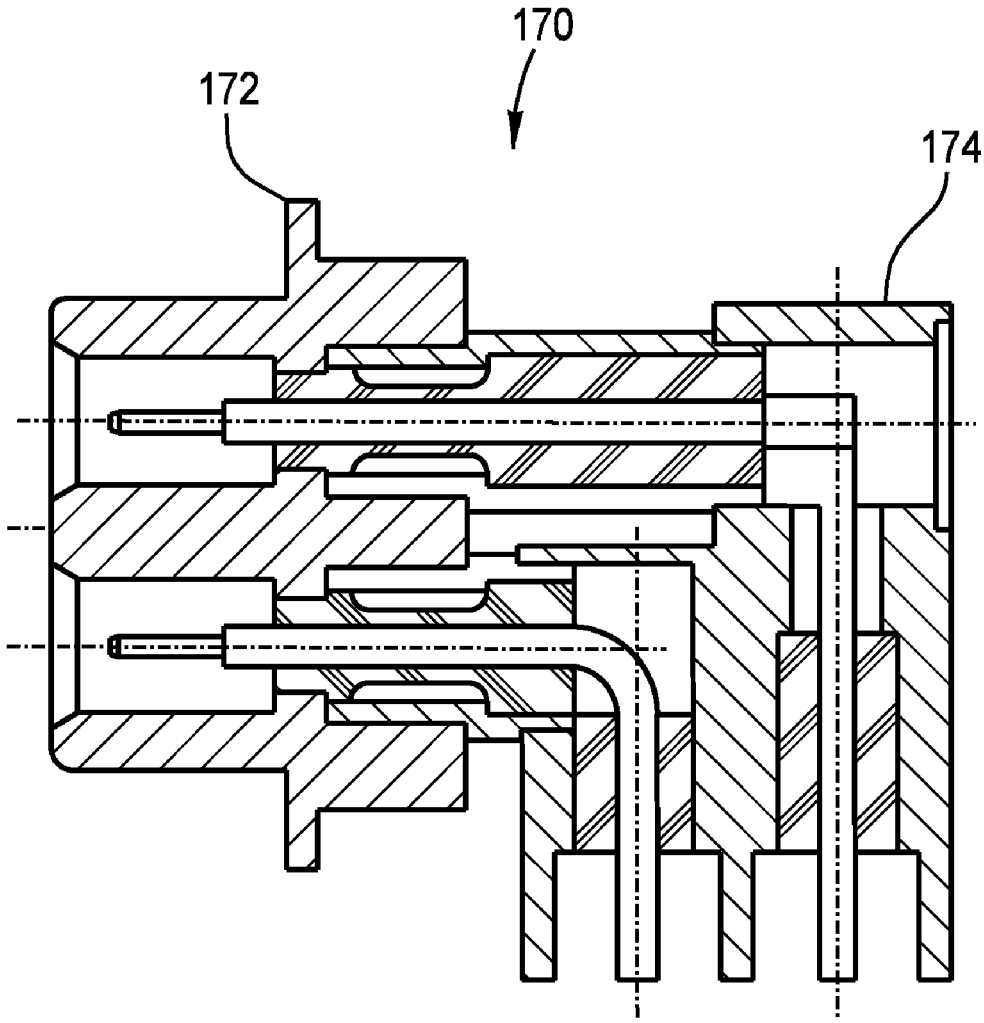
FIG. 3 is a side section view of a receptacle according to some embodiments of the disclosed subject matter.

In some embodiments, receptacle 104 includes a transition body 166 between D-sub housing 150 and rear unibody 164. Referring now to FIG. 3, in some embodiments, a receptacle 170 includes a D-sub housing 172 that is directly connected to a rear unibody 174 without a transition body. However, where the D-sub housing and rear unibody are both fabricated from die cast soft metals, transition body 166 can help provide a more robust connection.

Figure 7A:
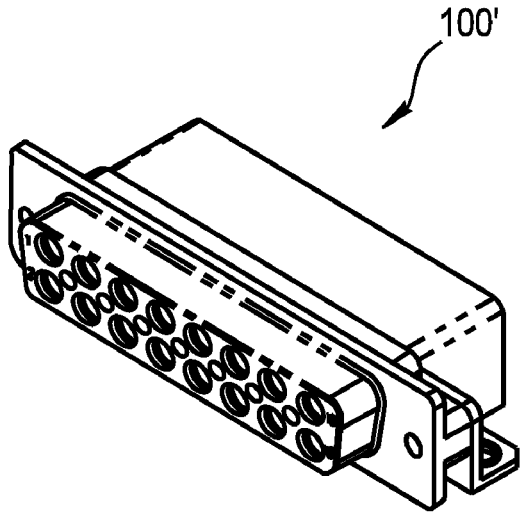
FIGS. 7A and 7B are isometric views of a connector according to some embodiments of the disclosed subject matter.
Figure 7B:
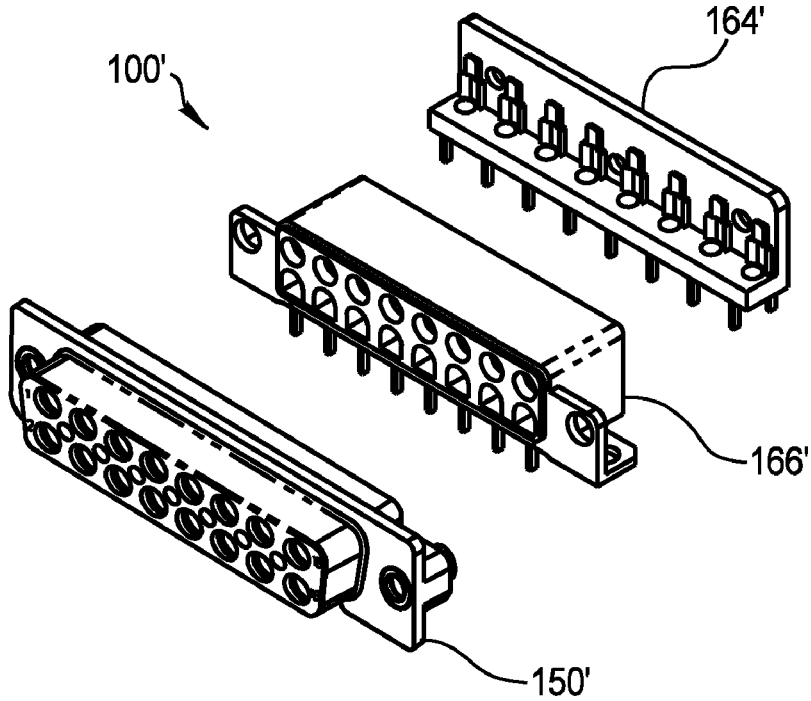

Referring now to FIGS. 7A and 7B, some embodiments include a connector system 100' having a D-sub housing 150' joined to a rear unibody 164' via a transition body 166'. In FIGS. 7A and 7B, rear unibody 164' includes a streamlined profile and transition body 166' is modified to fully enclose all wire contacts. As one skilled in the art will appreciate, both transition body 166' and rear unibody 164' can be modified depending on the requirements of a particular application. For example, rear unibody 164' could be separated into multiple pieces so as to no longer be a unibody.

Referring now to FIGS. 1 and 4, in some embodiments, connector system 100 includes a mechanism for verifying that plug 102 is mated with a correct one of receptacle 104. An example of one mechanism is including indentations 180 in surface 152 of D-sub housing 150 of receptacle 104 that mate with protrusions 182 extending from surface 110 of D-sub housing 108 of plug 102. The number and dimensions of protrusions 182 and indentations 180 can be varied according to a predetermined scheme to identify particular plugs and receptacles. For example, in addition to being longer than an outer edge 184 of D-sub housing 108 as illustrated in FIGS. 1A and 4, protrusions 182 can also be sized to be flush with or shorter than the outer edge. Also, either plugs or receptacles can include indentations or protrusions and vice versa.

Both plug 102 and receptacle 104 can include standard connecting screw holes 190 for removably connecting the plug to the receptacle to ensure the connection is not broken due to slight movement or vibration. Also, either plug 102 or receptacle 104 can include a mounting screw hole 192 for mounting either one to a surface (not shown).

Overall, plug 102 and receptacle 104 are generally configured to provide about a 50-Ohm impedance across system 100 and are configured to operate under a ground-first condition. System is typically adapted to operate effectively in about a 1 GHz range.

The present invention offers advantages over prior art designs. As technology has advanced, a need for connector systems that work with systems having 64 channels has developed. Using the known 8W8 connector systems requires the stacking of eight separate connector systems. Using the present invention only requires the stacking of four separate connector systems, thereby decreasing the amount of space required.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. A connector system comprising:

a plug including the following:

a D-sub housing having a front surface, said housing being sized no larger than size five;

two rows of eight RF coaxial contacts extending from said front surface of said D-sub housing, each of said RF coaxial contacts including a center contact portion and an insulator portion, each of said RF coaxial contacts having a closed entry configuration;

a receptacle including the following:

a D-sub housing having a front surface including two rows of eight openings therein, said D-sub housing being sized no larger than size five; and a receptacle contact positioned in each of said eight openings, each of said receptacle contacts being configured to mate with one of said RF coaxial contacts via said closed entry configuration, each of said receptacle contacts having first and second sections, said receptacle contacts being positioned so that at least a portion of said first section is positioned in said D-sub housing;

wherein said insulator portions are configured to provide about a 50-Ohm impedance across said system and said plug and receptacle are configured to operate under a ground-first condition.

2. A connector system according to claim 1, further comprising a rear unibody joined with said D-sub housing, said rear unibody being positioned so that at least a portion of said second portions of said receptacle contacts is positioned within said rear unibody.

3. A connector system according to claim 1, further comprising means for verifying that said plug is mated with a correct one of said receptacle.

4. A connector system according to claim 2, wherein means for verifying includes indentations in a surface of said D-sub housing of one of said plug and receptacle and corresponding protrusions extending from a surface of said D-sub housing of one of said plug and said receptacle, said indentations and said protrusions being configured to mate with one another.

5. A connector system according to claim 1, wherein said closed entry configuration is defined by a guided entry hole having chamfered edges.

6. A connector system according to claim 1, wherein said RF coaxial contact includes means for making a pressure-fit or friction mating connection with said RF coaxial contact mating portion.

7. A connector system according to claim 6, wherein said means for making a pressure-fit or friction mating connection includes finger portions defined on a front body portion of said RF coaxial contact.

8. A connector system according to claim 1, wherein said center contact portion has a diameter that is smaller than a diameter of about a size eight contact according to the American Wire Gauge standard.

9. A connector system according to claim 1, wherein said center contact portion has a diameter that is larger than a diameter of about a size eight contact according to the American Wire Gauge standard.

10. A connector system according to claim 9, further comprising modified insulator portions that are configured so that said plug and receptacle provide about a 50-Ohm impedance across said system.

11. A connector system according to claim 1, wherein said system is adapted to operate in about a 1 GHz range.

12. A connector system according to claim 2, wherein said receptacle further comprises a transition body between said D-sub housing and said rear unibody.

13. A connector system according to claim 12, wherein said D-sub housing and said rear unibody are fabricated from a die cast zinc material.

14. A connector system according to claim 1, wherein said center contact is fabricated from beryllium copper or similar.

15. A connector system comprising:

a plug including the following:

a D-sub housing having a front surface, said housing being sized no larger than size five;

two rows of eight RF coaxial contacts extending from said front surface of said D-sub housing, each of said RF coaxial contacts including a center contact portion and an insulator portion, each of said RF coaxial contacts having a closed entry configuration;

a receptacle including the following:

a D-sub housing having a front surface including two rows of eight openings therein, said D-sub housing being sized no larger than size five;

a receptacle contact positioned in each of said eight openings, each of said receptacle contacts being configured to mate with one of said RF coaxial contacts via said closed entry configuration, each of said receptacle contacts having first and second sections, said receptacle contacts being positioned so that at least a portion of said first section is positioned in said D-sub housing; and a rear unibody joined with said D-sub housing, said rear unibody being positioned so that at least a portion of said second portions of said receptacle contacts is positioned within said rear unibody; and a transition body positioned between and joining said D-sub housing and said rear unibody;

wherein said insulator portions are configured to provide about a 50-Ohm impedance across said system and said plug and receptacle are configured to operate under a ground-first condition.

16. A connector system according to claim 15, further comprising means for verifying that said plug is mated with a correct one of said receptacle.

17. A connector system according to claim 15, wherein said RF coaxial contact includes means for making a pressure-fit or friction mating connection with said RF coaxial contact mating portion.

18. A connector system comprising:

a plug including the following:

a D-sub housing having a front surface, said housing being sized no larger than size five;

two rows of eight RF coaxial contacts extending from said front surface of said D-sub housing, each of said RF coaxial contacts including a center contact portion and an insulator portion, each of said RF coaxial contacts having a closed entry configuration;

protrusions extending from said front surface of said D-sub housing;

a receptacle including the following:

a D-sub housing no larger than size five, said housing including a surface having two rows of eight openings, said surface having indentations, said indentations being sized and positioned so as to mate with said protrusions extending from said plug;

a receptacle contact positioned in each of said eight openings, each of said receptacle contacts being configured to mate with one of said RF coaxial contacts via said closed entry configuration, each of said receptacle contacts having first and second sections, said receptacle contacts being positioned so that at least a portion of said first section is positioned in said D-sub housing; and a rear unibody joined with said D-sub housing, said rear unibody being positioned so that at least a portion of said second portion of said receptacle contact portion is positioned within said rear unibody;

wherein said insulator portions are configured to provide about a 50-Ohm impedance across said system and said plug and receptacle are configured to operate under a ground-first condition.

19. A connector system according to claim 18, wherein said center contact portion has a diameter that is larger than a diameter of about a size eight contact according to the American Wire Gauge standard and said system further comprises modified insulator portions that are configured so that said plug and receptacle provide about a 50-Ohm impedance across said system.

* * * * *